US008459755B1

(12) United States Patent
Shupe et al.

(10) Patent No.: US 8,459,755 B1
(45) Date of Patent: Jun. 11, 2013

(54) SPACE SAVING WARDROBE OR CLOSET

(76) Inventors: Stephan A. Shupe, Bluff City, TN (US); Christopher L. Shupe, Bluff City, TN (US)

( * ) Notice: Subject to any disclaimer, the term of this patent is extended or adjusted under 35 U.S.C. 154(b) by 0 days.

(21) Appl. No.: 13/134,129

(22) Filed: May 31, 2011

(51) Int. Cl.

| | |
|---|---|
| ***A47B 67/02*** | (2006.01) |
| ***A47B 43/00*** | (2006.01) |
| ***A47B 47/00*** | (2006.01) |
| ***A47F 5/08*** | (2006.01) |
| ***B65D 6/00*** | (2006.01) |
| ***B65D 8/14*** | (2006.01) |

(52) U.S. Cl.
USPC ..... 312/248; 312/262; 220/6

(58) Field of Classification Search
USPC ..... 312/245, 205, 107, 108, 248, 258, 312/262, 265.5, 265.6; 220/8, 6, 666, 4.28; 16/366, 368, 369, 370, 371, 287, 288, 289, 16/302
See application file for complete search history.

(56) References Cited

U.S. PATENT DOCUMENTS

| | | | | | |
|---|---|---|---|---|---|
| 149,488 | A * | 4/1874 | Leary | 312/245 |
| 498,804 | A * | 6/1893 | Manning | 312/262 |
| 700,237 | A * | 5/1902 | Randall | 312/205 |
| 842,821 | A * | 1/1907 | Tryon | 312/205 |
| 933,210 | A * | 9/1909 | Ullom | 217/14 |
| 1,199,293 | A * | 9/1916 | Montgomery | 312/258 |
| 1,372,229 | A * | 3/1921 | Jelenc | 312/205 |
| 3,458,242 | A * | 7/1969 | Williams | 312/258 |
| 3,583,781 | A * | 6/1971 | Yamawaki et al. | 312/258 |
| 3,797,905 | A * | 3/1974 | Naske | 312/262 |
| 4,134,629 | A * | 1/1979 | Hansen | 312/246 |
| 5,222,611 | A * | 6/1993 | Wood et al. | 211/94.01 |
| 5,468,061 | A * | 11/1995 | Fries et al. | 312/258 |
| 6,398,323 | B1 * | 6/2002 | Lee | 312/205 |
| 6,422,626 | B1 * | 7/2002 | Beigel | 296/24.4 |
| 6,606,806 | B2 * | 8/2003 | Butters et al. | 38/137 |

* cited by examiner

*Primary Examiner* — Janet M Wilkens
*Assistant Examiner* — Andrew Roersma

(57) ABSTRACT

A portable, folded wardrobe wherein in a ready-to-use state, opposing side sections and two front doors are positioned symmetrically on either side of a center longitudinal plane, and wherein when in a folded storage state the side sections and doors have been rotated laterally and folded whereby they are non-symmetrically positioned with respect to said plane and whereby the longitudinal dimension (front to back) of the wardrobe is markedly reduced and the lateral dimension is concordantly increased.

5 Claims, 3 Drawing Sheets

FIG. 1
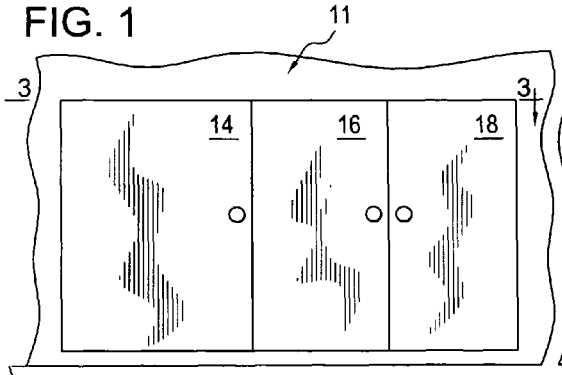
FIG. 2
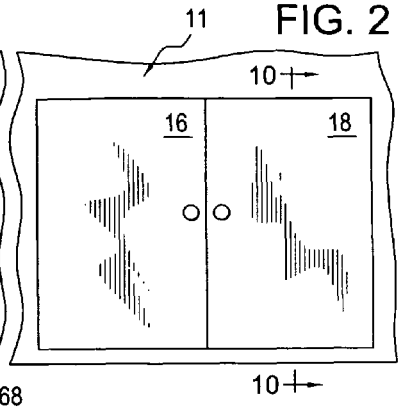
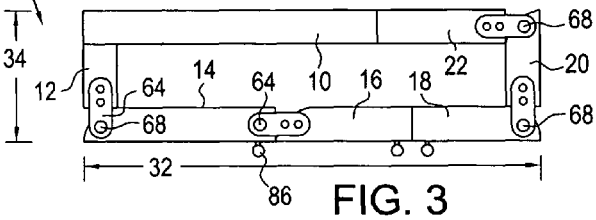
FIG. 3
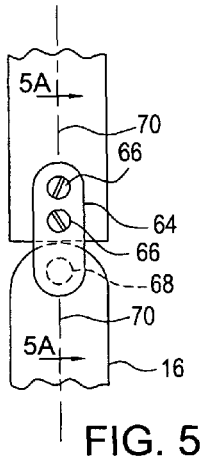
FIG. 5
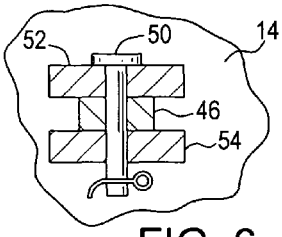
FIG. 6
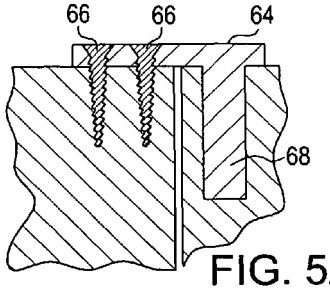
FIG. 5A
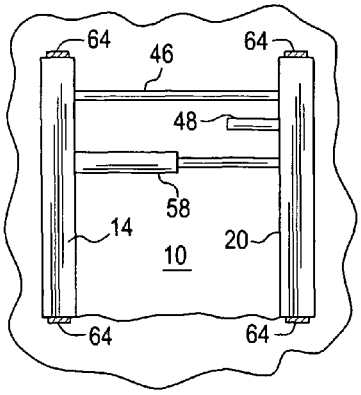
FIG. 7
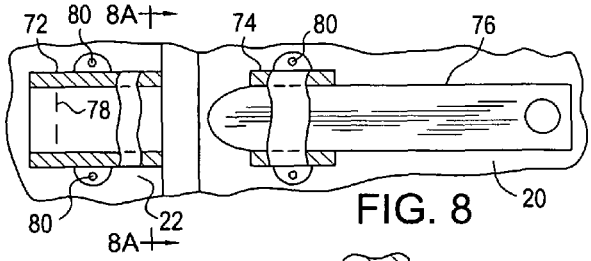
FIG. 8
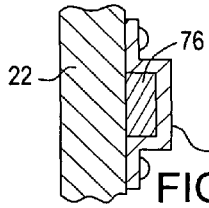
FIG. 8A

SPACE SAVING WARDROBE OR CLOSET

BACKGROUND

Field

This invention concerns a portable, collapsible wardrobe or close particularly for use where a wardrobe would be desirable on a temporary basis and where, in its collapsed (constructed) condition, its room occupying dimensions would be reduced to a fraction of its ready to use expanded state.

SUMMARY OF THE INVENTION

A portable, foldable wardrobe wherein in a ready-to-use state, opposing side sections and two front doors are positioned symmetrically on either side of a center longitudinal plane to form two halves of the wardrobe wherein when in a folded storage state the side sections and doors have been rotated laterally folded whereby they are non-symmetrically positioned with respect to said plane and whereby the longitudinal dimension (front to back) of the wardrobe is markedly reduced and the lateral dimension is concordantly increased, and wherein tandem struts are strategically provided between and attached to structural components of the wardrobe to mandate that pivoting of one of the components will force all movable components into a lateral, rotative motion.

BRIEF DESCRIPTION OF THE DRAWINGS

The invention will be understood further from the drawings herein and their description wherein the figures are not drawn to scale or consistent proportions and are intended to describe principles of the present invention and preferred embodiment thereof, and wherein:

FIG. 1 is a front view of the wardrobe mounted on a room wall and in its folded state;

FIG. 2 is a front view of the wardrobe of FIG. 1 and in its expanded, ready-to-use state;

FIG. 3 is a top down view taken along line 3-3 in FIG. 1;

FIG. 5 shows a preferred hinge (pivot) structure which allows the door panels to pivot readily 180°;

FIG. 5A is a cross sectional view taken along line 5A-5A in FIG. 5;

FIG. 6 is a cross-sectional view taken along line 6-6 in FIG. 4;

FIG. 7 is a cross-sectional view taken along line 7-7 in FIG. 4 and showing the vertical spatial locations of struts and clothes hanger rod;

FIGS. 8 and 8A shows the dotted area in FIG. 4 (not in proportion to other components) fitted with a sliding bar lock for rigidifying the wardrobe structure in its operative (expanded) state;

FIG. 8A is a cross-sectional view taken along line 8A-8A in FIG. 8;

DETAILED DESCRIPTION

Figure 4:
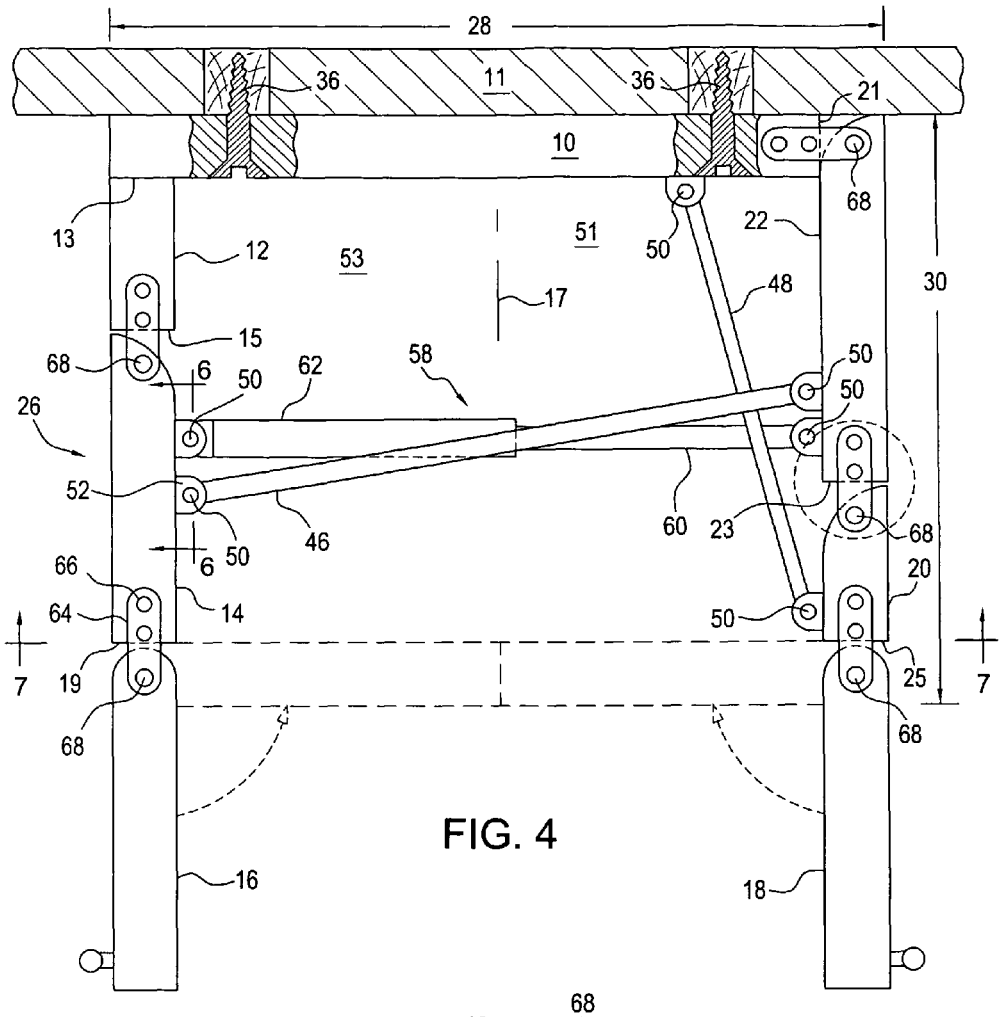
FIG. 4 is a view as in FIG. 3 with the side walls and panels rotated laterally to the left to the ready-to-use state of the wardrobe and showing the locations of the pivot joints (approximately) and the tandem struts and clothes hanger rod.

Referring to the drawings and with particular reference to the claims herein, the present wardrobe structure has a rectangular rear wall 10 adapted for mounting on a room wall 11, a rectangular first side wall 12 fixed in position on one vertical edge portion 13 of said rear wall and extending outwardly at a right angle therefrom, a rectangular first side panel 14 pivotally mounted on an outer vertical edge portion 15 of said side wall and adapted to be swung toward or away from a center plane 17 of said wardrobe structure which divides the structure into right hand 51 and left hand 53 halves when the structure is in its expanded state (mode), a rectangular first door panel 16 pivotally mounted on an outer vertical edge portion 19 of said first side panel and adapted to be swung toward or away from said center plane, a rectangular second side panel 22 pivotally mounted on the other vertical edge portion 21 of said rear wall and adapted to be swung toward or away from said center plane, a rectangular second side wall 20 pivotally mounted on an outer vertical edge portion 23 of said rectangular second side panel and adapted to be swung toward or away from said center plane, and a rectangular second door panel 18 pivotally mounted on an outer vertical edge portion 25 of said second side wall.

In the above structure all of the pivotal mountings allow the side panels, the second side wall and the door panels to be swung laterally to the left (FIG. 4) in unison about their pivoted mountings to (A) form an expanded rectangular ready-to-use wardrobe 26 having a lateral dimension 28 and a longitudinal dimension 30, or (B) swung to the right (FIG. 3) to form a folded rectangular stored wardrobe wherein its lateral dimension 32 is markedly lengthened and its longitudinal dimension 34 is markedly contracted to, e.g., ¼ of the longitudinal expanded dimension 30 (FIG. 4).

It is noted that the components of the wardrobe which provides halves 51 and 53 can be reversed so as to reverse the positions and the direction in which the components laterally rotate the halves shown in FIG. 4.

Figure 10:
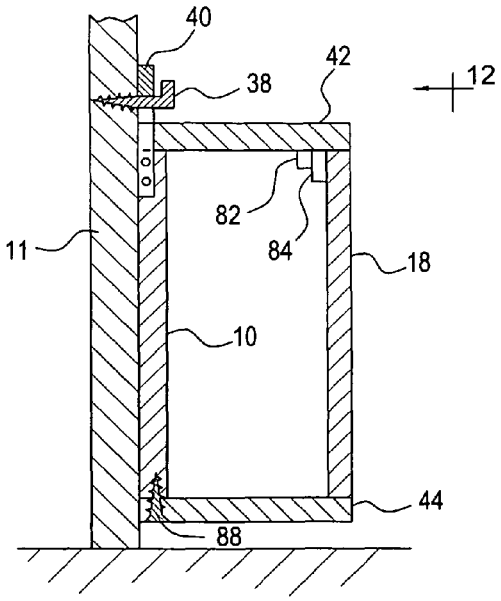
FIG. 10 is a cross-section taken along line 10-10 in FIG. 9 and additionally shows an attachment of top and floor sections to the rear wall of the wardrobe, and magnetic door closers on said top section.
Figure 9:
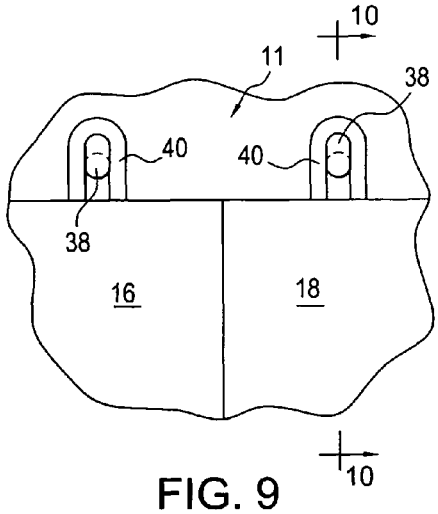
FIG. 9 is a front view of an upper portion of the wardrobe showing a hanger type of attachment of the wardrobe to a room wall.

Any type of attachment means may be used to mount the wardrobe on room wall 11 as shown, e.g., in FIG. 4 by screws 36. A alternative would be to use hanger structures such as screws 38 and apertured receivers 40 as shown in FIGS. 9 and 10. It is noted that it is not necessary to provide a top 42 or a floor 44 to the wardrobe structure, however, if such is desired for the storage mode, they can be, e.g., affixed by, e.g., screws 88 to the rear wall 10 as shown in FIG. 10.

Figure 11:
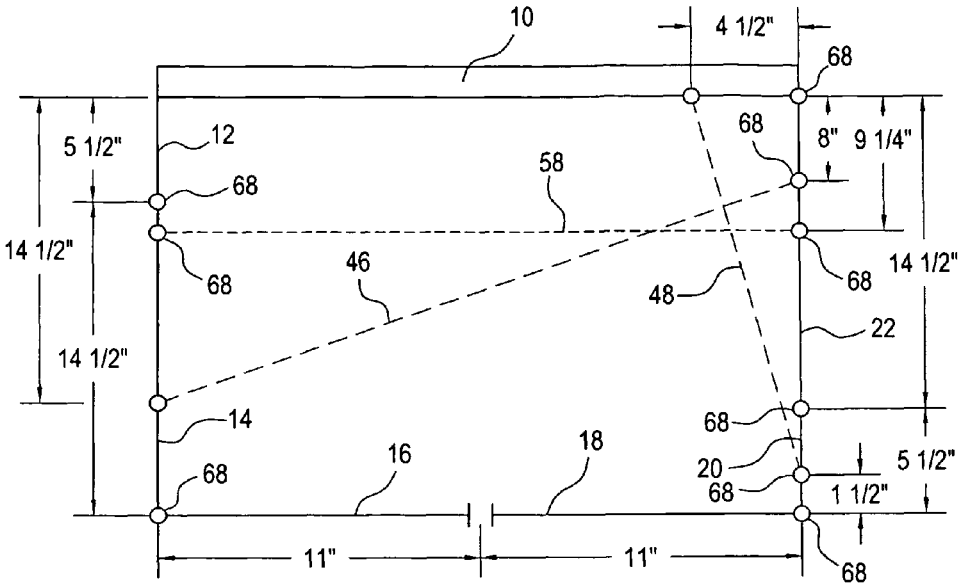
FIG. 11 is a line schematic showing typical (approximate) dimensions and pivot locations.

Referring to FIG. 4, struts 46 and 48 are pivotally mounted as shown, 46 to 22 and 14, and 48 to 10 and 20, and cause these walls and panels to move in tandem whether the wardrobe is being expanded or folded. The positioning of the pivots of these struts is important and an example of wardrobe dimensions is given in FIG. 11 in schematic line form for one size of wardrobe. The pivot points are black dots. Scaling up or down of the wardrobe will change the pivot points of the struts, and their (pivot point) adjustments can be readily made by those skilled in the art.

Referring to FIG. 6 and as an example, the end of strut 46 is pivotally mounted by pin 50 which is bearinged in bracket plates 52, 54 affixed to side panel 14. This type of pivot structure is preferred for all strut pivots as well as for the clothes bar 58. Bar 58 is a permanent installation and is shown as a rod 60 slidable without significant resistance in a cylinder 62 whereby its lengthening or shortening is readily accommodated during expansion or folding of the wardrobe.

Referring to FIGS. 5 and 5A, a preferred type of pivot structure for the wardrobe components of walls, panels and doors comprises sturdy metal plates 64 affixed to the top edge and bottom edge of each component, where appropriate, by screws (wood) 66 and to an adjacent component by pivot lugs 68. Common hinges may also be used, however, the aforesaid plates allow the plane lines 70 of adjacent components to align and present a smooth artistic appearance.

Figure 4A:
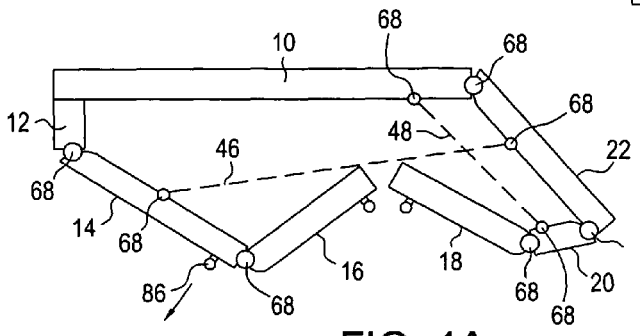
FIG. 4A is a top down view of the wardrobe structure showing a general angular relationship of the side walls, side panels, door panels and tandem struts when the wardrobe is approximately ½ way expanded (or folded)

Referring to FIGS. 8 and 8A, a sliding bar type of locking or rigidifying bar structure is shown for preventing inopportune folding of the wardrobe and comprises a pair of channels 72, 74 screwed as at 80 to components 22 and 20 respectively for slidably receiving bar 76. When bar 76 is inserted thru 72 to about point 78, components 20 and 22 will not be able to pivot relative to each other and the expanded wardrobe shape will be preserved. Also, as shown in FIG. 10, doors 16 and 18 can be urged closed by permanent magnets 82 affixed to the underside of top section 42 in cooperation with steel members 84 affixed to the upper inner portions of the doors. In opening (expanded) the wardrobe a tug on knob 86 in a forward direction as shown in FIG. 4A will cause the tandem struts 46 and 48 to rotate laterally all other movable components of the structure due to the positioning of the strut end connections.

The invention has been described in detail with particular reference to preferred embodiments thereof, but it will be understood that variations and modifications will be effected within the spirit and scope of the invention.

We claim:

1. An expandable and foldable wardrobe structure having a rectangular rear wall adapted for mounting on a room wall, a rectangular first side wall fixed in a permanent position on and at a right angle with respect to a first vertical portion of said rear wall and extending outwardly and forwardly therefrom, a rectangular first side panel pivotally mounted on an outer vertical edge portion of said first side wall and adapted to be swung toward or away from a center plane of said wardrobe structure, a rectangular first door panel pivotally mounted on an outer vertical edge portion of said first side panel and adapted to be swung toward or away from said center plane, a rectangular second side panel pivotally mounted on a second vertical portion of said rear wall and spaced laterally from said first vertical portion and adapted to be swung toward or away from said center plane, a rectangular second side wall pivotally mounted on an outer vertical edge portion of said rectangular second side panel and adapted to be swung toward or away from said center plane, and a rectangular second door panel pivotally mounted on an outer vertical edge portion of said second side wall, wherein one end of a first tandem strut is pivotally attached to said second side wall and the other end of said first tandem strut is pivotally attached to said rear wall, and wherein one end of a second tandem strut is pivotally attached to said first side panel and the other end of said second tandem strut is pivotally attached to said second side panel, wherein the angular positions and lengths of said struts are selected to rotate laterally all of said components in unison between expanded and folded states, wherein pivotal mountings allow the side panels, the second side wall and the door panels to be swung laterally in unison about the mountings (A) to form an expanded rectangular ready-to-use wardrobe having a lateral dimension which is markedly contracted and having a longitudinal dimension which is markedly expanded, or (B) to form a folded, rectangular stored wardrobe having a lateral dimension which is markedly lengthened and having a longitudinal dimension which is markedly contracted.

2. The wardrobe of claim 1 wherein a longitudinally retractable clothes hanger is affixed to and extending between said first and second side panels.

3. The wardrobe of claim 2 wherein hanger means is provided an upper portion of said rear wall for removably mounting said wardrobe on a room wall.

4. The wardrobe of claim 2 wherein top and floor sections are affixed to said rear wall.

5. The wardrobe of claim 1 wherein said components are pivotally connected to each other by means of metal plates having a first portion stationarily affixed to edge portions of one component, and having a pivot stud bearinged in one edge portion of an adjacent component.

* * * * *